US011678745B2

(12) United States Patent
Zou et al.

(10) Patent No.: US 11,678,745 B2
(45) Date of Patent: Jun. 20, 2023

(54) RECLINER MECHANISM FOR ELECTRIC ROCKING CHAIR

(71) Applicant: Jiangsu Carya Smart Home Hardware Co., Ltd, Yangzhou (CN)

(72) Inventors: Guoli Zou, Yangzhou (CN); Jianbo Sha, Yangzhou (CN); Wei Lu, Yangzhou (CN)

(73) Assignee: Jiangsu Carya Smart Home Hardware Co., Ltd., Yangzhou (CN)

( * ) Notice: Subject to any disclaimer, the term of this patent is extended or adjusted under 35 U.S.C. 154(b) by 0 days.

(21) Appl. No.: 17/538,808

(22) Filed: Nov. 30, 2021

(65) Prior Publication Data

US 2023/0111098 A1 Apr. 13, 2023

(30) Foreign Application Priority Data

Oct. 8, 2021 (CN) ..... 202122415660.4

(51) Int. Cl.
*A47C 1/027* (2006.01)
*A47C 3/02* (2006.01)

(52) U.S. Cl.
CPC ..... *A47C 1/027* (2013.01); *A47C 3/02* (2013.01)

(58) Field of Classification Search
None
See application file for complete search history.

(56) References Cited

U.S. PATENT DOCUMENTS 4,367,895 A * 1/1983 Pacitti ..... A47C 1/0355 297/85 L
4,828,213 A * 5/1989 Saito ..... B60N 2/1685 297/344.14
4,852,939 A * 8/1989 Krauska ..... A47C 1/0345 297/DIG. 10
6,000,758 A * 12/1999 Schaffner ..... A47C 1/0345 297/DIG. 10
2006/0249992 A1* 11/2006 LaPointe ..... A47C 1/0345 297/68
2016/0120314 A1* 5/2016 Catana ..... A47C 1/143 297/354.12
2018/0360217 A1* 12/2018 Fei ..... A61G 5/14

FOREIGN PATENT DOCUMENTS

CN 203314484 U 12/2013

* cited by examiner

*Primary Examiner* — David E Allred
(74) *Attorney, Agent, or Firm* — Bayramoglu Law Offices LLC

(57) ABSTRACT

A recliner mechanism includes a base. Returning spring units are disposed on two sides of the base and rockers are disposed on outer sides of the returning spring units. An extending assembly is disposed at the top of each rocker. A drive unit is arranged between the extending assemblies on the two sides and includes a front driving rod. A reciprocating device is disposed at the middle of the front driving rod and a rear driving rod is disposed at an output end of the reciprocating device. Bent members are fixedly connected to two ends of the rear driving rod. Each bent member is pivotally coupled with a driving member I and the middle of the driving member I is pivotally coupled with a driving member II, with the other ends of the driving member I and the driving member II being pivotally coupled with the extending assemblies.

5 Claims, 4 Drawing Sheets

RECLINER MECHANISM FOR ELECTRIC ROCKING CHAIR

CROSS REFERENCE TO THE RELATED APPLICATIONS

This application is based upon and claims priority to Chinese Patent Application No. 202122415660.4, filed on Oct. 8, 2021, the entire contents of which are incorporated herein by reference.

TECHNICAL FIELD

The present invention relates to the field of furniture manufacture, and in particular, to a recliner mechanism for an electric rocking chair.

BACKGROUND ART

CN203314484U discloses a multi-link rocking power mechanism, in which due to lack of guidance at the joints of a drive unit and extending assemblies, the mechanical extending assemblies on two sides are often asynchronous in movement, which results in poor user experience.

SUMMARY

In view of the defects in the prior art, the present invention is aimed at providing a recliner mechanism for an electric rocking chair that ensures simultaneous movement of extending assemblies on two sides and improves the user experience.

To realize the above purpose, the recliner mechanism for an electric rocking chair provided in the present invention adopts the following technical solutions:

A recliner mechanism for an electric rocking chair includes a base. Returning spring units are disposed on two sides of the base and rockers are disposed on outer sides of the returning spring units. An extending assembly is disposed at the top of each rocker. A drive unit is arranged between the extending assemblies on the two sides and includes a front driving rod. A reciprocating device is disposed at the middle of the front driving rod and a rear driving rod is disposed at an output end of the reciprocating device. Bent members are fixedly connected to two ends of the rear driving rod. Each bent member is pivotally coupled with a driving member I and the middle of the driving member I is pivotally coupled with a driving member II, with the other ends of the driving member I and the driving member II being pivotally coupled with the extending assemblies. The driving member I is fixedly connected with a first limiting pin, and a kidney-shaped hole for the first limiting pin to slide is formed in each bent member.

Preferably, the extending assembly includes a seat plate unit having a mounting plate fixedly connected to the corresponding rocker. A front portion of the mounting plate is pivotally coupled with a front connecting rod I, and the other end of the front connecting rod I is pivotally coupled with a front connecting rod II. The middle of the front connecting rod II is pivotally coupled with a seat mounting plate. A second limiting pin is mounted on the seat mounting plate. The front connecting rod II has a first limiting surface matched with the second limiting pin. A front end of the seat mounting plate is pivotally coupled with a footrest unit, and a tail end of the seat mounting plate is pivotally coupled with a backrest unit.

Preferably, the footrest unit includes a foot plate that is pivotally coupled with a footrest connecting rod I and a footrest connecting rod II. The other end of the footrest connecting rod I is pivotally coupled with a footrest connecting rod III, while the other end of the footrest connecting rod II is pivotally coupled with a footrest connecting rod IV. Tail portions of the footrest connecting rod IV and the footrest connecting rod III are pivotally coupled to a front portion of the seat mounting plate. A rear portion of the footrest connecting rod II is pivotally coupled with a front portion of the footrest connecting rod III. A third limiting pin is mounted on the footrest connecting rod II, and the footrest connecting rod III has a second limiting surface and a third limiting surface that are matched with the third limiting pin.

Preferably, the backrest unit includes a backrest mounting plate, with a front end of the backrest mounting plate being pivotally coupled with the front connecting rod II, a middle-front portion of the backrest mounting plate pivotally coupled with the seat mounting plate and a rear portion of the backrest mounting plate pivotally coupled with a backrest rotating member. The backrest rotating member is also pivotally coupled to the mounting plate. The backrest rotating member is pivotally coupled with a backrest driving member, and a fourth limiting pin is mounted on the other end of the backrest driving member. A first limiting member matched with the fourth limiting pin is disposed at the middle of the backrest driving member. One end of the first limiting member is pivotally coupled with the backrest driving member, while the other end thereof is pivotally coupled with the mounting plate. A fifth limiting pin is mounted on the backrest driving member. The backrest mounting plate is pivotally coupled with a second limiting member, and a slotted hole for the fifth limiting pin to slide is formed in the second limiting member.

Preferably, the reciprocating device includes a motor hinged with the front driving rod, and the motor operates to drive a sliding block which is fixedly connected to the middle of the rear driving rod to slide on a sliding rail.

Compared with the prior art, the present invention has the following advantages:

1. When the reciprocating device is started to enable the front driving rod and the rear driving rod to drive the extending assemblies to extend or retract, the first limiting pin slides in the kidney-shaped hole to provide guidance for the rotation of the driving member I and the driving member II, thereby ensuring simultaneous movement of the mechanical extending assemblies on the two sides and improving the user experience.
2. Parts of the seat plate unit are reduced, thereby reducing the manufacturing cost.

List of Reference Numbers: 1, base; 2, returning spring unit; 3, rocker; 4, extending assembly; 41, seat plate unit; 411, mounting plate; 412 front connecting rod I; 413 front connecting rod II; 4131, first limiting surface; 414, seat mounting plate; 42, footrest unit; 421, foot plate; 422, footrest connecting rod I; 423, footrest connecting rod III; 4231, second limiting surface; 4232, third limiting surface; 424, footrest connecting rod II; 425, footrest connecting rod VI; 43, backrest unit; 431, backrest mounting plate; 432, backrest rotating member; 433, backrest driving member; 434, first limiting member; 435, second limiting member; 4351, slotted hole; 5, drive unit; 51, front driving rod; 52, reciprocating device; 56, driving member II; 521, motor; 522, sliding block; 523, sliding rail; 53, rear driving rod; 54, bent member; 541, kidney-shaped hole; 55, driving member I; 56, driving member II; 601, first shaft; 602, second shaft; 603, third shaft; 604, fourth shaft; 605, fifth shaft; 606, sixth shaft; 607, seventh shaft; 608, eighth shaft; 609, ninth shaft; 610, tenth shaft; 611, eleventh shaft; 612, twelfth shaft; 613, thirteenth shaft; 614, fourteenth shaft; 615, fifteenth shaft; 616, sixteenth shaft; 617, seventeenth shaft; 618, eighteenth shaft; 619, nineteenth shaft; 620, twentieth shaft; 621, twenty first shaft; 622, twenty second shaft; 701, second limiting pin; 702, third limiting pin; 703, fourth limiting pin; 704, fifth limiting pin; and 705, first limiting pin.

DETAILED DESCRIPTION OF THE EMBODIMENTS

The present invention is further described with reference to the accompanying drawings and specific embodiments. It should be understood that such embodiments are merely intended to illustrate the present invention, but not to limit the scope of the present invention. After reading the description, various modifications made to the present invention by those skilled in the art that are in equivalent forms and similar to the structure of the present invention shall fall within the scope defined by the appended claims.

Figure 1:
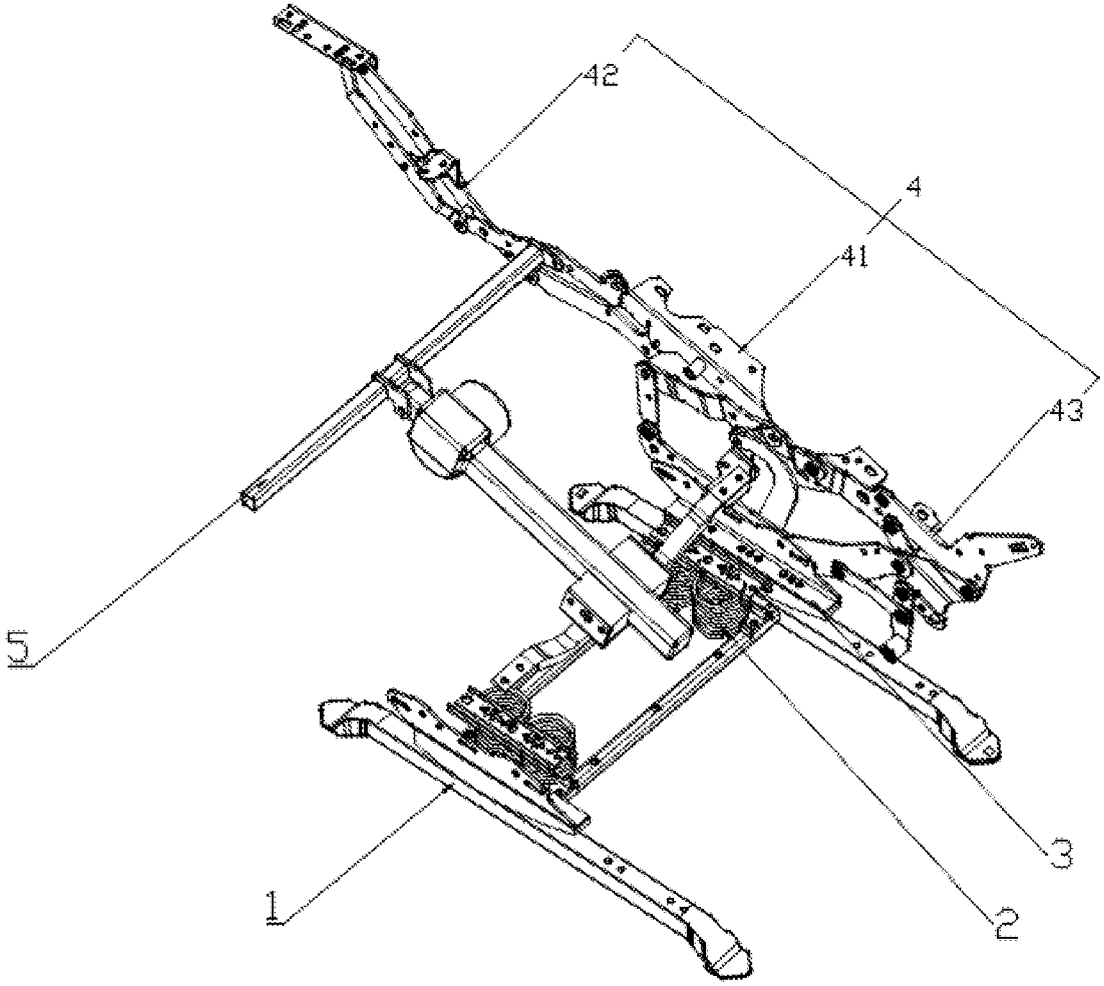
FIG. 1 is a structural schematic diagram of a recliner mechanism for an electric rocking chair according to the present invention.
Figure 2:
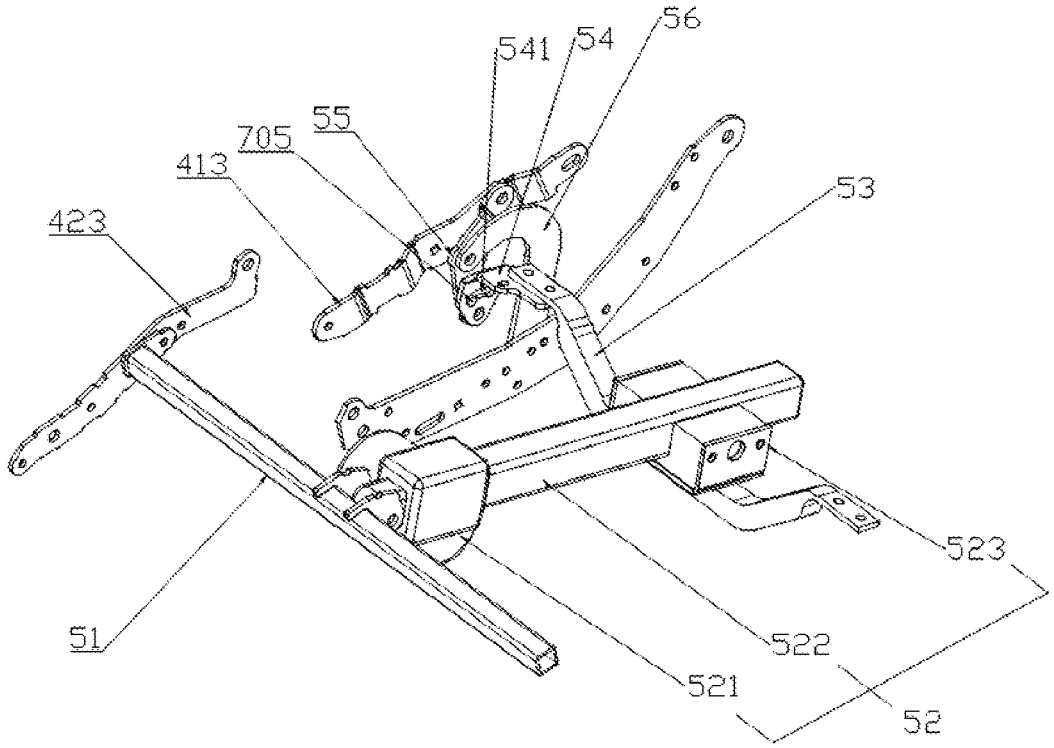
FIG. 2 is a structural schematic diagram of a drive unit.
Figure 3:
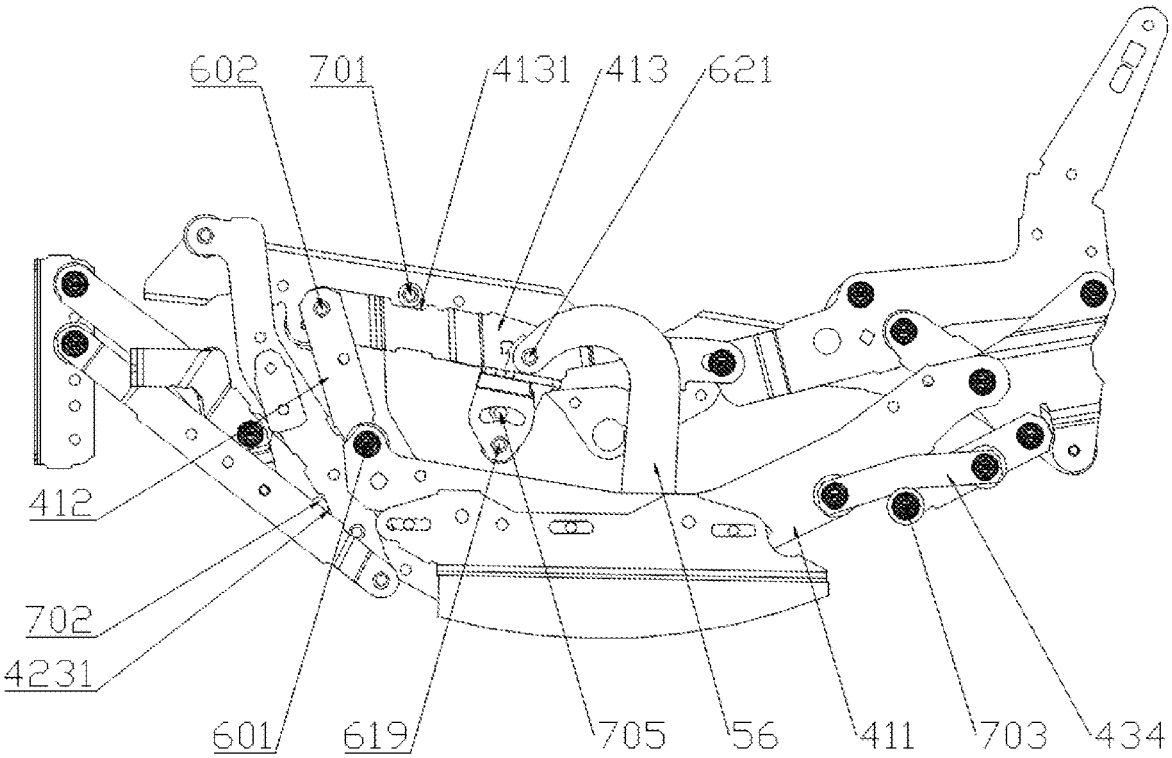
FIG. 3 is a front view of an extending assembly in an upright position.
Figure 4:
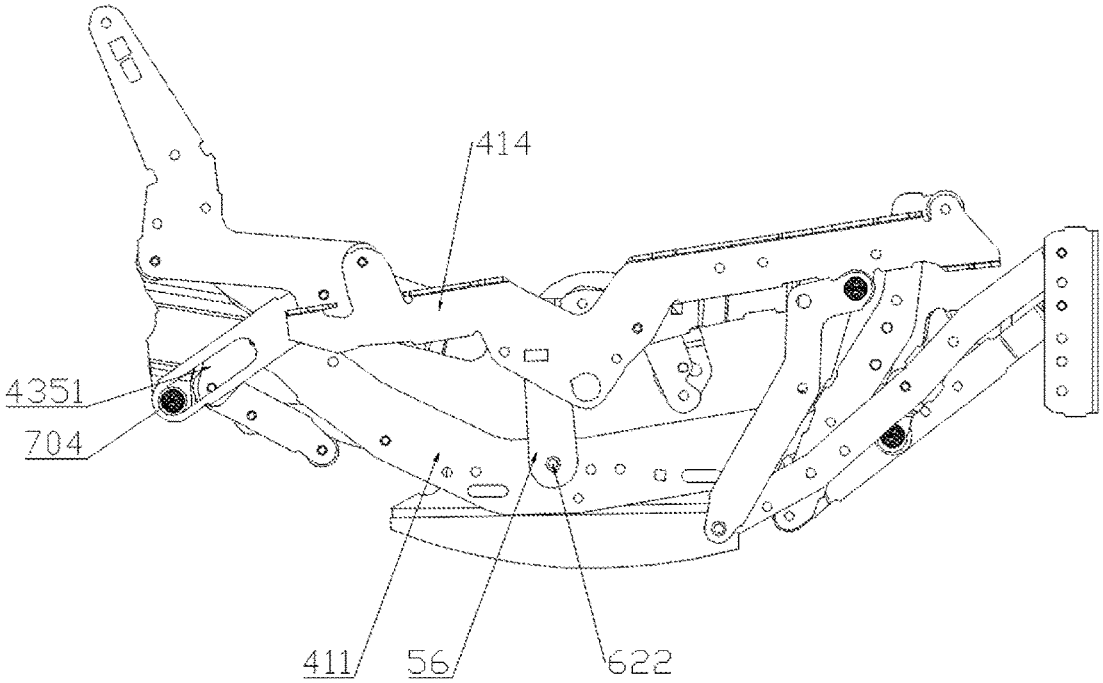
FIG. 4 is a rear view of the extending assembly in the upright position.
Figure 5:
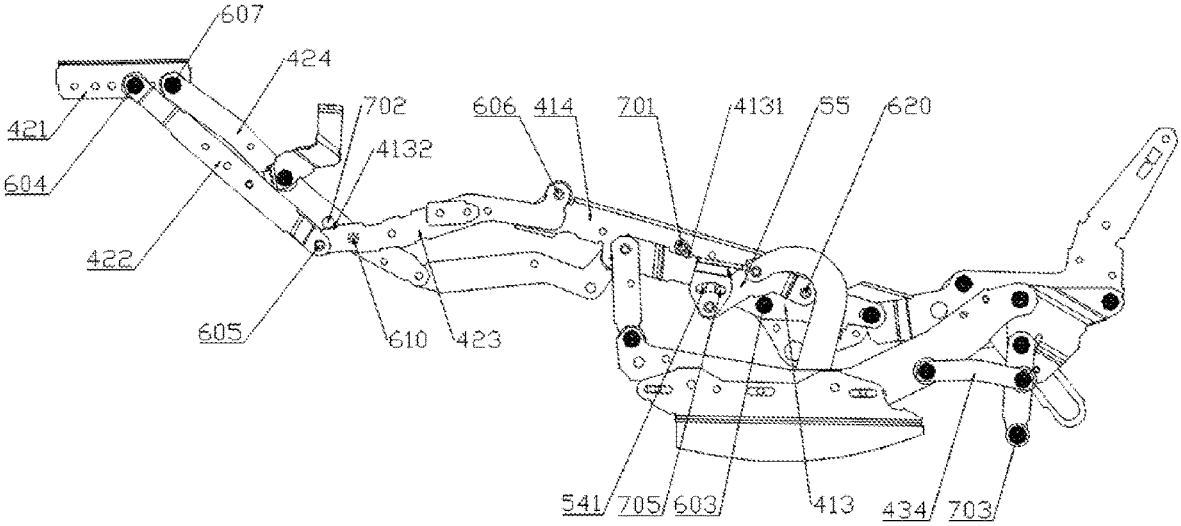
FIG. 5 is a front view of the extending assembly in a TV position.
Figure 6:
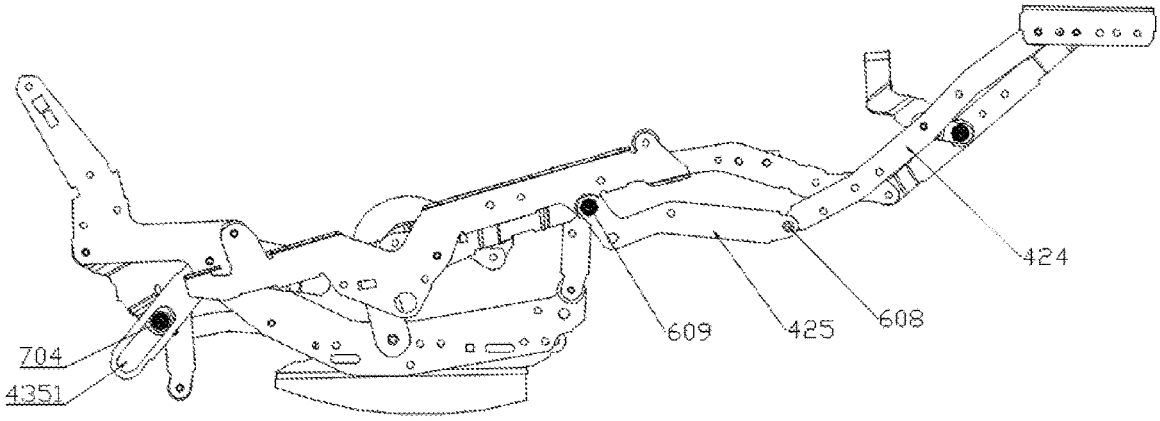
FIG. 6 is a rear view of the extending assembly in the TV position.
Figure 7:
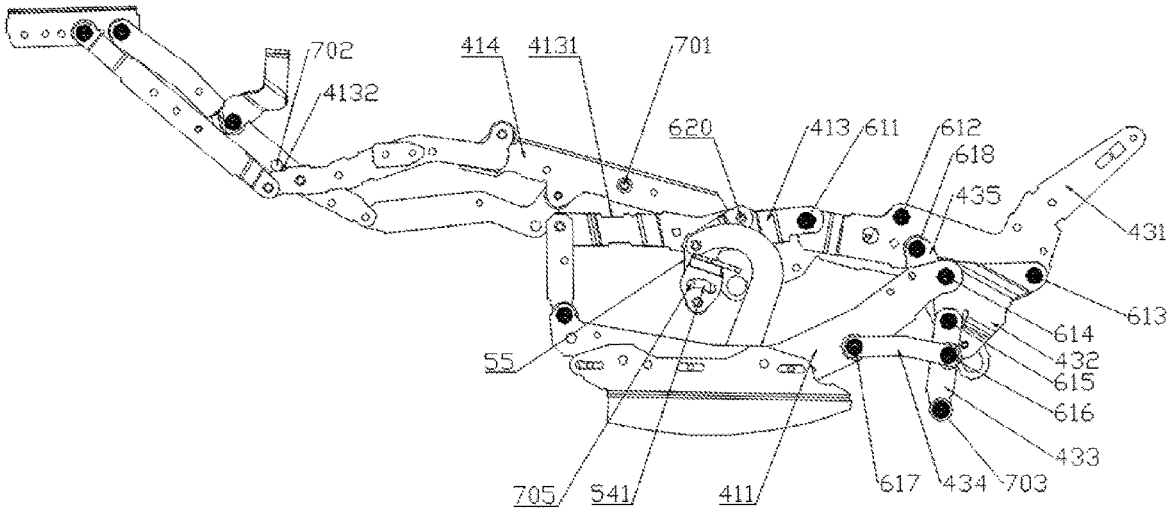
FIG. 7 is a front view of the extending assembly in a reclining position.
Figure 8:
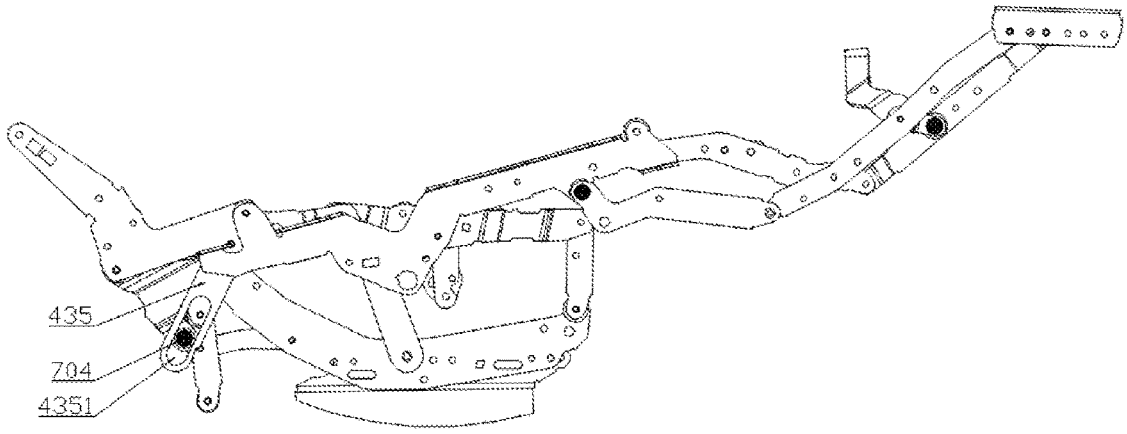
FIG. 8 is a rear view of the extending assembly in the reclining position.

As shown in FIG. 1 to FIG. 8, a recliner mechanism for an electric rocking chair includes a base 1. Returning spring units 2 are disposed on two sides of the base. A rocker 3 is arranged on the outer side of each returning spring unit. An extending assembly 4 is disposed at the top of each rocker. The extending assembly includes a seat plate unit 41, and the seat plate unit includes a mounting plate 411 fixedly connected with the corresponding rocker. The front portion of the mounting plate is pivotally coupled with a front connecting rod I 412 through a first shaft 601. The front connecting rod I is pivotally coupled with a front connecting rod II 413 through a second shaft 602. The front connecting rod II is pivotally coupled with a seat mounting plate 414 through a third shaft 603. A second limiting pin 701 is mounted on the seat mounting plate. The front connecting rod II has a first limiting surface 4131 matched with the second limiting pin. The front end of the seat mounting plate is pivotally coupled with a footrest unit 42. The footrest unit includes a foot plate 421. The foot plate is pivotally coupled with a footrest connecting rod I 422 through a fourth shaft 604. The footrest connecting rod I is pivotally coupled with a footrest connecting rod III 423 through a fifth shaft 605. The footrest connecting rod III is pivotally coupled to the front portion of the seat mounting plate through a sixth shaft 606. The foot plate is pivotally coupled with a footrest connecting rod II 424 through a seventh shaft 607. The footrest connecting rod II is pivotally coupled with a footrest connecting rod IV 425 through an eighth shaft 608. The footrest connecting rod IV is pivotally coupled to the front portion of the seat mounting plate through a ninth shaft 609. The footrest connecting rod II is pivotally coupled with the footrest connecting rod III through a tenth shaft 610. A third limiting pin 702 is mounted on the footrest connecting rod II. The footrest connecting rod III has a second limiting surface 4231 and a third limiting surface 4232 that are matched with the third limiting pin. The tail end of the seat mounting plate is pivotally coupled with a backrest unit 43. The backrest unit includes a backrest mounting plate 431. The backrest mounting plate is pivotally coupled with the front connecting rod II through an eleventh shaft 611. The backrest mounting plate is pivotally coupled with the seat mounting plate through a twelfth shaft 612. The backrest mounting plate is pivotally coupled with a backrest rotating member 432 through a thirteenth shaft 613. The backrest rotating member is pivotally coupled to the tail portion of the mounting plate through a fourteenth shaft 614. The backrest rotating member is pivotally coupled with a backrest driving member 433 through a fifteenth shaft 615. A fourth limiting pin 703 is mounted on the other end of the backrest driving member. A first limiting member 434 matched with the fourth limiting pin is arranged at the middle of the backrest driving member. One end of the first limiting member is pivotally coupled with the backrest driving member through a sixteenth shaft 616, while the other end thereof is pivotally coupled with the mounting plate through a seventeenth shaft 617. A fifth limiting pin 704 is mounted on the backrest driving member. The backrest mounting plate is pivotally coupled with a second limiting member 435 through an eighteenth shaft 618. A slotted hole 4351 for the fifth limiting pin to slide is formed in the second limiting member. A drive unit 5 is arranged between the extending assemblies on two sides. The drive unit includes a front driving rod 51 fixedly connected with the footrest connecting rod III. A reciprocating device 52 is arranged at the middle of the front driving rod. The reciprocating device includes a motor 521 hinged with the front driving rod. The motor operates to drive a sliding block 522 which is fixedly connected with a rear driving rod 53 to slide on a sliding rail 523. Bent members 54 are fixedly connected to two ends of the rear driving rod. The bent member is pivotally coupled with a driving member I 55 through a nineteenth shaft 619. The driving member I is pivotally coupled with the front connecting rod II through a twentieth shaft 620. The driving member I is pivotally coupled with a driving member II 56 through a twenty: first shaft 621. The driving member II is pivotally coupled to the mounting plate through a twenty: second shaft 622. The driving member I is fixedly connected with a first limiting pin 705. A kidney-shaped hole 541 for the first limiting pin to slide is formed in the bent member.

A specific operating process and principles of the present invention are as follows:

When in an upright position, the sliding block is nearest to the motor, with the first limiting pin being located at the middle of the kidney-shaped hole, the second limiting pin abutting against the first limiting surface, the third limiting pin abutting against the second limiting surface, the fourth limiting pin abutting against the first limiting member and the fifth limiting pin being located at the lower portion of the slotted hole. In this case, the extending assemblies are retracted.

When the upright position is changed to a TV position, the motor is started, allowing the sliding block and the motor to move away from each other. Thus, the front driving rod moves to unfold the footrest unit, and the rear driving rod moves to drive by means of the driving member I and the driving member II the seat plate unit to extend, with the first limiting pin sliding to the rear bottom of the kidney-shaped hole, the second limiting pin abutting against the first limiting surface, the third limiting pin abutting against the third limiting surface, the fourth limiting being separated from the first limiting member, the fifth limiting pin being located at the upper portion of the slotted hole. In this case, the extending assemblies are half extended.

When the TV position is changed to a reclining position, the motor is started to operate continuously, allowing the first limiting pin to slide to the front bottom of the kidney-shaped hole, the second limiting pin to be separated from the first limiting surface, the third limiting pin to abut against the third limiting surface, the fourth limiting pin to be separated from the first limiting member and the fifth limiting pin to be located at the middle of the slotted hole.

In this case, the extending assemblies are fully extended.

What is claimed is:

1. A recliner mechanism for an electric rocking chair, comprising a base, returning spring units disposed on two sides of the base and rockers disposed on outer sides of the returning spring units, wherein an extending assembly is disposed at a top of each rocker; a drive unit is arranged between the extending assemblies on the two sides and comprises a front driving rod, a reciprocating device disposed at a middle of the front driving rod and a rear driving rod disposed at an output end of the reciprocating device; bent members are fixedly connected to two ends of the rear driving rod; each bent member is pivotally coupled with a first end of a first driving member and a middle of the first driving member is pivotally coupled with a first end of a second driving member, a second end of the first driving member and a second end of the second driving member are pivotally coupled to the extending assemblies; the first driving member is fixedly connected with a first limiting pin; and a kidney-shaped hole is formed in each bent member, wherein the first limiting pin slides through the kidney-shaped hole.

2. The recliner mechanism for an electric rocking chair according to claim 1, wherein each extending assembly comprises a seat plate unit having a mounting plate fixedly connected to a corresponding rocker; a front portion of the mounting plate is pivotally coupled with a first end of a first front connecting rod, and a second end of the first front connecting rod is pivotally coupled with a second front connecting rod; a middle of the second front connecting rod is pivotally coupled with a seat mounting plate; a second limiting pin is mounted on the seat mounting plate; the second front connecting rod has a first limiting surface matched with the second limiting pin; a front end of the seat mounting plate is pivotally coupled with a footrest unit; and a tail end of the seat mounting plate is pivotally coupled with a backrest unit.

3. The recliner mechanism for an electric rocking chair according to claim 2, wherein the footrest unit comprises a foot plate, wherein the foot plate is pivotally coupled with a first end of a first footrest connecting rod and a first end of a second footrest connecting rod; a second end of the first footrest connecting rod is pivotally coupled with a third footrest connecting rod, while a second end of the second footrest connecting rod is pivotally coupled with a fourth footrest connecting rod; tail portions of the fourth footrest connecting rod and the third footrest connecting rod are pivotally coupled to a front portion of the seat mounting plate; a rear portion of the second footrest connecting rod is pivotally coupled with a front portion of the third footrest connecting rod; a third limiting pin is mounted on the second footrest connecting rod; and the third footrest connecting rod has a second limiting surface and a third limiting surface that are matched with the third limiting pin.

4. The recliner mechanism for an electric rocking chair according to claim 2, wherein the backrest unit comprises a backrest mounting plate, wherein a front end of the backrest mounting plate is pivotally coupled with the second front connecting rod, a middle-front portion of the backrest mounting plate is pivotally coupled with the seat mounting plate and a rear portion of the backrest mounting plate is pivotally coupled with a backrest rotating member; the backrest rotating member is also pivotally coupled to the mounting plate; the backrest rotating member is pivotally coupled with a first end of a backrest driving member, and a fourth limiting pin is mounted on a second end of the backrest driving member; a first limiting member matched with the fourth limiting pin is disposed at a middle of the backrest driving member; a first end of the first limiting member is pivotally coupled with the backrest driving member, while a second end of the first limiting member is pivotally coupled with the mounting plate; a fifth limiting pin is mounted on the backrest driving member; the backrest mounting plate is pivotally coupled with a second limiting member; and a slotted hole for the fifth limiting pin to slide is formed in the second limiting member.

5. The recliner mechanism for an electric rocking chair according to claim 1, wherein the reciprocating device comprises a motor hinged with the front driving rod, and the motor operates to drive a sliding block which is fixedly connected to a middle of the rear driving rod to slide on a sliding rail.

* * * * *